United States Patent [19]

Weissman

[11] Patent Number: 4,808,959

[45] Date of Patent: Feb. 28, 1989

[54] ELECTRICAL COIL WITH TAP TRANSFERRING TO END-LAYER POSITION

[75] Inventor: Adrian M. Weissman, South Orange, N.J.

[73] Assignee: MagnaTek Universal Manufacturing, Paterson, N.J.

[21] Appl. No.: 175,951

[22] Filed: Mar. 31, 1988

[51] Int. Cl.[4] ..... H01F 15/10; H01F 41/10

[52] U.S. Cl. ..... 336/189; 29/605; 242/7.14; 336/192

[58] Field of Search ..... 29/602 R, 605, 606; 310/206, 207, 71, 234; 242/158 R, 7.02, 7.07, 7.09, 7.14, 7.15, 7.16; 336/189, 190, 191, 192, 224, 222, 225, 198, 208

[56] References Cited

U.S. PATENT DOCUMENTS

| | | | |
|---|---|---|---|
| 1,590,282 | 6/1926 | Cadden et al. | 336/192 |
| 2,787,769 | 4/1957 | Hill et al. | 336/192 |
| 3,772,626 | 11/1973 | Russell | 336/192 |

*Primary Examiner*—Thomas J. Kozma
*Attorney, Agent, or Firm*—Darby & Darby

[57] ABSTRACT

Disclosed is a coil including winding support means for supporting a base layer of wire including a first predetermined number of turns wound in a precision pattern about the support means. A wire tap layer is wound about the support means at an average pitch ratio substantially equal to a second predetermined number of turns for the tap layer divided into the first predetermined number of turns. A tap of wire is then taken from an end of said wire tap layer. Finally, a subsequent wire layer is wound over and in an opposite direction to the tap layer, wound at an average pitch ratio substantially equal to the first predetermined number of turns in the tap layer divided by the difference between the first predetermined number of turns and the second predetermined number of turns.

The present invention is also directed to a method of winding a coil.

21 Claims, 2 Drawing Sheets

ELECTRICAL COIL WITH TAP TRANSFERRING TO END-LAYER POSITION

FIELD OF THE INVENTION

The present invention relates to electrical coils. More particularly, the invention is directed to coils having taps made at an end-layer position, and a method for making such coils.

BACKGROUND OF THE INVENTION

Winding of coils for transformers is a well known art and many different transformer configurations have been used in the past and are available today. Typically, a transformer coil includes a bobbin having a number of layers of wound wire, each layer of wound wire applied over a prior layer of wound wire.

In the manufacture of coils, it sometimes becomes necessary to tap a lead from an intermediate layer of wound wire, i.e., a layer wound about the bobbin, onto which an additional layer or layers are to be wound. The previously available process for tapping such a lead from the coil during manufacture is rather cumbersome. For example, if a tap is to be made at a point midway across a layer of wound wire, the winding process must be halted in order that a certain amount of wire can be unwound from the wire feed spool and from the transformer coil bobbin itself. The two wire ends are then secured by twisting and anchoring them outside of the winding area of the coil bobbin.

The winding process is then resumed at the point on the layer where the tap was made. The winding for that layer proceeds until the end of the layer is reached. Winding then stops again, so that spacers may be attached to the bobbin in such a manner that the difference in height between the pre-tap portion of the wound coil and the post-tap portion can be eliminated. The subsequent layer is then wound over the tapped layer and the spacers. The winding process at this stage is slow and often results in a misalignment of layers on wound over the tapped layer. In the situation where a precision winding pattern is required, the tapping process described above often adversely effects the precision of the pattern, resulting in a high reject rate. As used herein, the term "precision winding" means that the wire in each layer makes the same number of turns, and the turns of successive layers are not randomly placed but are neatly stacked or nested one on top of another. Each turn of wire is wound immediately adjacent the wire of the previous turn, in a generally spiral pattern about the bobbin core or other winding axis. The winding pattern is not strictly spiral. Rather, the wire is would normal to the winding axis about most of the winding axis; the wire advances to the next position at a crossover point. In the case of a rectangular bobbin, the wire is wound normal to the axis for three of the four sides of the bobbin. Between the third and fourth corners of the rectangle the wire is angled to rest adjacent the wire from the previous turn at corner 4. This pattern is repeated throughout the winding of the layer, such that the turns are parallel to one another for three of the four sides of the bobbin; the crossover point is consistently on one side of the bobbin.

OBJECTS OF THE INVENTION

It is an object of the present invention to provide an inductance coil in which taps can be made at any layer of the coil, and all subsequently would layers maintain any desired precise winding pattern.

An additional object is provide an inductance coil having intermediate taps taken at the end of a predetermined layer by changing the winding pitch of the wound layer on which the taps are taken.

An additional object is to provide a coil for an inductor or transformer having an intermediate tap at the end of the layer in which all layers are of equal thickness.

SUMMARY OF THE INVENTION

These and other objects are met by the present invention directed to a coil including winding support means for supporting a base layer of wire including a first predetermined number of turns wound in a precision pattern about the support means. A wire tap layer is wound about the support means at an average pitch ratio substantially equal to a second predetermined number of turns for the tap layer divided into the first predetermined number of turns. A tap of wire is then taken from an end of said wire tap layer. Finally, a subsequent wire layer is wound over and in an opposite direction to the tap layer, wound at an average pitch ratio substantially equal to the first predetermined number of turns in the tap layer divided by the difference between the first predetermined number of turns and the second predetermined number of turns.

The present invention is also directed to a method of winding a coil.

BRIEF DESCRIPTION OF THE DRAWINGS

Other objects and advantages of the invention will become more apparent upon reference to the following specification and annexed drawings in which.

DETAILED DESCRIPTION OF THE INVENTION

Figure 1:
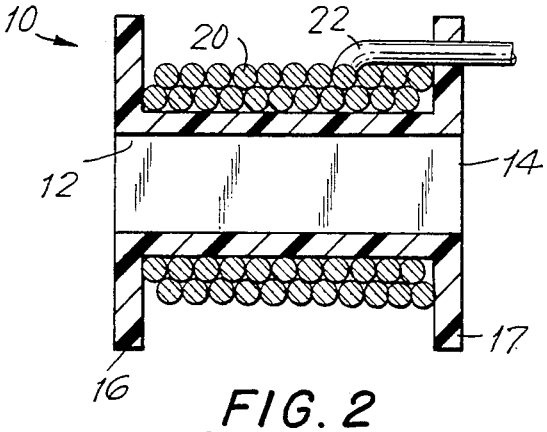
FIG. 1 PRIOR ART
FIG. 1 is a cross-sectional view of a prior art coil showing a precision winding.

Referring to the drawings, and in particular, FIG. 1, there is shown a conventional rectangular-shaped bobbin 10 for a coil which is to be used in the inductor, transformer or other similar device. The bobbin 10 is made of any suitable insulating material, e.g. plastic, and has a center core 12 with a through opening 14 into which the arbor of the winding machine (not shown) is inserted. Flanges 16 and 17 are provided at each end of core 12.

Electrically conductive wire 20 is wound about the predefined winding axis of core 12. FIG. 1 shows such a winding which is made in a precision pattern. As seen, the wire 20 is spirally wound about the core 12. The winding is typically started at one end of the core, e.g., adjacent flange 16. The wire is then wound in a continuous spiral pattern with each turn of the wire lying adjacent to the previous turn. For a rectangular-shaped bobbin, the wire is spirally wound by winding wire 20 normal to the predefined winding axis for three sides of the rectangle. Between two successive corners, e.g. the third and fourth corners, wire 20 skips from a parallel path at the third corner to a position adjacent the wire previously laid down at the fourth corner. The wire is then wound normal to the predefined winding axis for the succeeding three corners.

The winding continues until the opposite end of the core is reached (e.g., at flange 17), thereby defining a layer. Wire 20 is generally of circular cross-section and uniform diameter, but wire of other geometric shapes can be used. Thus, when the first layer is wound about core 12, a surface consisting of a series of alternating convex ridges and concave grooves is created. A second layer is then started by continuing winding of wire 20 into the first groove adjacent the last turn of wire in the underlying layer. The turns of the second layer are laid in the series of grooves defined by the spirally wound wire of the underlying layer. The process continues for each subsequent layer until the desired number of turns have been wound about the core. Similarly, on the next layer, the turns are laid in the space between each two turns of the next layer.

Figure 2:
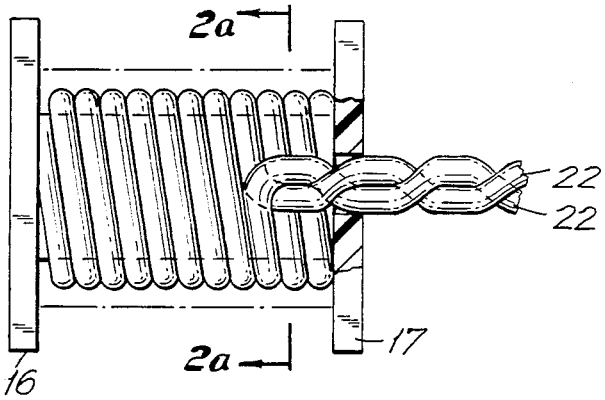
FIG. 2 PRIOR ART
FIG. 2 is a top plan view of FIG. 1, showing how a bobbin would normally have an intermediate tap.
Figure 2A:
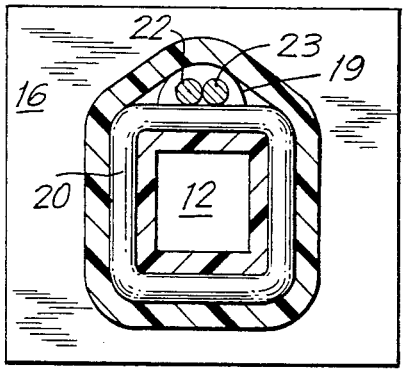
FIG. 2a PRIOR ART
FIG. 2A is a cross-sectional view of a coil having a spacer arch over a tap, and a subsequent layer of wire wound over the arch.

As shown in FIG. 1, often times a tap 23 is made in one of the intermediate layers, sometimes at the mid-point of such a layer, in order to impart desired electrical characteristics to the coil. Often a coil must have a specific number of turns, at which point a tap must be made. Depending on the length of core 12 and the thickness of wire 20, this tap point may occur anywhere along a layer, at which point, the wire is conventionally pulled against the direction of winding, generally perpendicular to the winding towards the outside of the coil to allow any electrical connections to be made. The wire is then drawn back (as wire 22) to the point of winding where the tap was made, and winding continues. Thus, a tap includes interrupting the winding of a coil after a predetermined number of turns have been wound, extending the winding wire towards the end of the core and outside of the coil, extending the same or a different length of wire from the outside of the coil towards the point of winding where the tap was taken, and resuming winding layers until the next tap point, if any, is reached. Depending on the specifications for a particular coil, one or more additional layers may be laid on top of the layer in which the tap was made. As can be easily understood and seen in FIGS. 1, 2 and 2*a*, the tap causes an unevenness in the layer having the tap, because the turns wound into the core after the tap is made must wind over the lengths of wire drawn perpendicular to the windings to and from the outside the coil for the tap. Additional layers wound over the tap layer cannot be smoothly wound onto the core because the series of alternating grooves and ridges formed by a wound layer, and relied on to guide the winding of subsequent layers, are disrupted when a tap is made. As shown in FIG. 2*a*, the unevenness caused by making a tap is smoothed somewhat by providing a spacer arch 19 to rest over the wires 22 and 23. However, even with a spacer arch the winding of wire is irregular, and precision winding is not possible.

FIGS. 3–4, and 5–6 show a transformer coil which is wound in accordance with the present invention. Here, a number of layers are wound in the manner shown in FIG. 1 up to the point where the tap is to be made.

If it is determined, for example, that the desired number of turns will occur at the mid-point of the next layer, (and a tap made at that point) then the winding of the layer to be tapped is altered according to the present invention.

Figure 3:
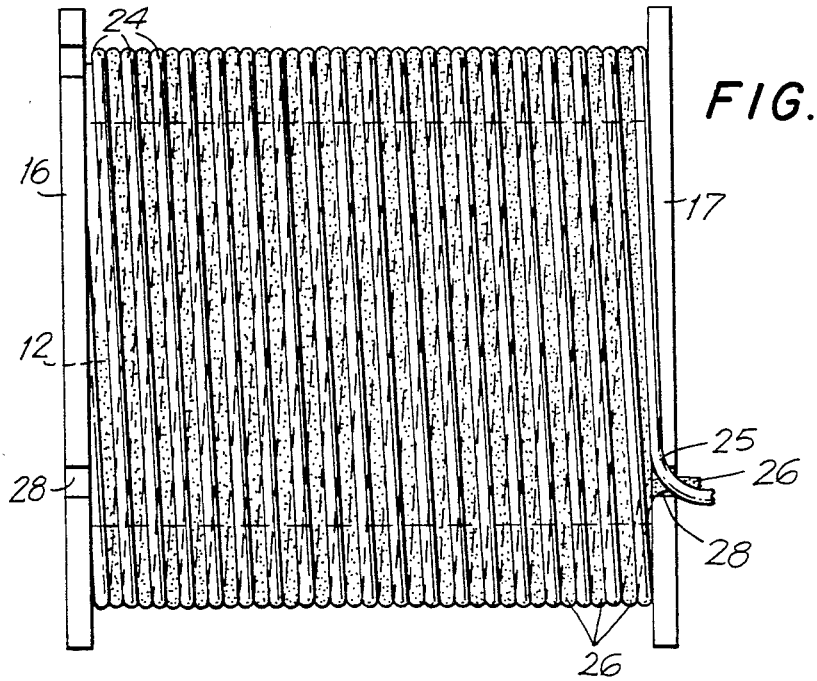
FIGS. 3 and 4 are top and partial side views, respectively, showing how a tap is made in accordance with the present invention.
Figure 4:
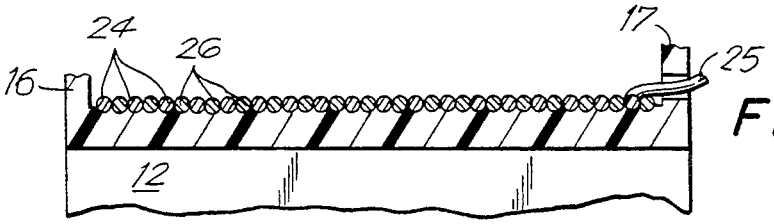

If the tap is to be made at the mid-point, i.e., at half the number of turns available for the layer, then the pitch of the winding is increased two-fold. Referring to FIG. 3, the wire 24 being wound is laid into alternating grooves, crossing over alternating ridges once per revolution about the core 12 (i.e., once per turn), generally between the third and fourth corners of the rectangular bobbin. In this manner, when the entire layer is wound, it will contain only half the number of turns it would have had if the pitch had not been increased two-fold. Thus, at the end of this tap layer, the tap 26 can be made at the end of the layer, such that no wire traverses the coil perpendicular to the windings.

The wire at the end of the tap layer can be drawn through an opening 28, such as an aperture or slot, in the wall of flange 16 or 17 to enable the tap to be made.

Thereafter, the wire drawn back to the core, optionally through opening 28, or another opening, and a subsequent layer is laid down in the opposite direction as the tap layer. The pitch of the wire 25 in this subsequent layer is the same as the pitch of the preceding layer, i.e. double the pitch of a non-tap layer. As shown in FIG. 3, this layer is wound into the grooves of the first layer not filled by the tap layer, and the windings of the tap layer are crossed, once per turn. From a groove at the third corner, two ridges are skipped and the wire settles into the groove at the fourth corner. When this subsequent layer reaches the end of the core at the opposite flange of the bobbin from whence the tap was taken, the original series of alternating ridges and grooves is created and any number of additional layers can be wound at normal pitch. If any additional taps are desired, the procedure described above can be used as many times as is practical.

From a numerical point of view, for example, assume that there are to be 66 turns of wire on a layer and the tap is to be taken at the mid-point. On the first layer of double pitch, there would be about 33 turns and the tap would be taken at the end of the layer. On the next layer, there would be 33 turns going in the opposite direction from the tap layer. Thereafter, the winding is resumed back to 66 turns per layer.

If the layer included an odd number of turns, e.g. 65 turns of wire per layer, a tap can still be taken at the mid-point. Here, the tap layer might have 32 turns would at double pitch and the subsequent layer would have 33 turns would in the opposite direction at double pitch. Conversely, the tap layer could be wound with 33 wires and the subsequent layer would have 32 turns.

If an additional tap is to be pulled, at a subsequent layer, the same procedure would be followed as described previously.

The invention as previously described assumes that the tap is to be made at the mid-point. However, the invention is not limited to this particular tapping procedure or location. For example, if it is determined that the tap is to be made at a point one-third the way through a normal layer, then those one-third turns would be wound onto the core, but at triple the pitch. The tap would then be taken. Thereafter, on the next layer going back in the opposite direction, the remaining number of turns which were not taken off during the tap layer would be laid down. Thus, if 22 turns were laid down for the tap layer, then the next layer would contain 44 turns. Thereafter, the layers continue with the standard number of turns (66) in the example being described.

The same situation would obtain in the opposite case. For example, if the tap is to be taken at two-thirds of a normal layer, instead of either one-half or one-third of the layer. Using the example of 66 turns per normal layer, the tap would be taken after a layer having a pitch such that 44 turns would fill the space between the two flanges on the bobbin. On the next layer in the opposite direction, the remainder of a full layer would be laid down, e.g. 22 turns in the above example. Thereafter the winding process would continue in the normal manner.

It can be seen that as a general rule the average winding pitch ratio of the tap layer and the subsequent layer can be easily calculated as follows:

$$\text{average pitch ratio of tap layer} = \frac{n}{Y}$$

$$\text{average pitch ratio of subsequent layer} = \frac{n}{n - Y}$$

where, n=number of turns of normal, base layer, and

Y=number of turns in tap layer.

This formula can be used to calculate the average pitch ratio for any number of turns in a tap layer. Thus, referring to FIG. 5, for example, the base layer has 9 turns, i.e., n=9 wound at a pitch of 1. If a tap is to be taken after a one third of the number of turns of a normal, or base layer, then the tap layer would contain only 3 turns of wire 24. Thus, according to the formula above, Y=3. To ensure that tap layer is evenly wound about the core, ending at the opposite end from the starting point, the average pitch ratio is calculated according to the formula above:

$$\text{average pitch ratio of tap layer} = \frac{n}{Y} = \frac{9}{3} = 3$$

Figure 5:
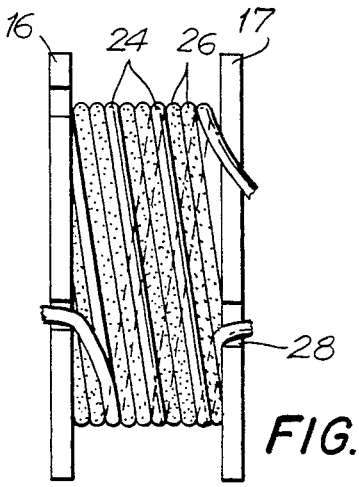
FIGS. 5 and 6 are top and partial side views, respectively, showing another tap made in accordance with the present invention.
Figure 6:
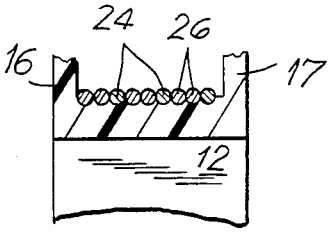

As shown in FIG. 5 the tap layer 24 is wound at an average pitch ratio of 3; the wire is laid into every third groove, once per turn. The subsequent layer 26 is calculated as:

$$\text{average pitch ratio of subsequent layer} = \frac{n}{n - Y} = \frac{9}{9 - 3} = 1.5$$

Thus, as shown in FIG. 5, the subsequent layer 26 is wound with a average pitch ratio of 1.5. However, it is not feasible to wind the layer with any non-integer pitch ratio because a non-integer pitch ratio involves winding angles which would not deposit wire directly into grooves of the preceding layer. This occurs because non-integer pitch ratios involve moving the wire at fractional (non-whole number) wire diameters. For this reason, the term "average pitch ratio" is used. Thus, where a average pitch ratio of 1.5 is required, the wire is wound by an alternating pitch ratio of 1 and 2, throughout the layer. The average of 1 and 2 is 1.5. In this manner, 6 turns of layer 26 will be made.

The winding of the coils of the present invention can be carried out by a winding machine, particularly one which is computer controlled and which can be programmed in the appropriate manner. That is, the program basically would be one which would wind the number of turns up until the layer of the tap is to be taken. Thereafter, the winding pitch would be increased so that the required number of turns, fewer than the full number for a layer, would be wound between the two flanges of the bobbin. The machine would then stop, or would be manually stopped by the operator, and the tap made. Thereafter, the machine would resume going back in the opposite direction to lay down the subsequent layer with the required number of turns to make up the total of the normal layer and thereafter continuing with the winding of the normal layer and the standard number of turns in such a layer.

The coil and process for winding the same as described above has substantial advantages over the prior art. First of all, substantial saving of labor are realized since the operator does not have to stop the machine at a mid-position on a layer, perform anchoring and spacing steps and thereafter start the winding again. Also, the intermediate tapping point on a layer is eliminated since all taps can be made to occur at the end of a wound layer, at the flange of the bobbin. This results in a coil which has no enlarged, uneven projections on any given layer. Consequently, the winding pattern is not disturbed and better electrical characteristics are achieved with fewer rejected coils.

The description above teaches the inclusion of a tap layer over a normal layer. Depending on the type of bobbin employed it is possible to include a tap layer as the first layer, i.e., before a normal layer has been wound onto the bobbin. This can be done where a "pre-grooved" bobbin is employed. Bobbins often include scoring or grooves, equally spaced and of the same diameter as the wire to be wound, located at each corner of the rectangular bobbin. Conventionally, the scoring is included to help guide the wire about the bobbin for winding the first layer for precision winding of a coil. This scoring can also be used for winding a tap layer as the first layer in a coil constructed according to the present invention. The scoring will retain the wire wound at a pitch ratio other than 1.

The above description of the invention relates to winding a coil about a bobbin. The invention can also be used in applications where no bobbin is used: i.e., self-supporting coils. A self-supporting coil is conventionally constructed by winding wire about a collapsible, rectangular mandrel. Usually the mandrel is scored with grooves as described above. In use, the mandrel is provided in a normal, non-collapsed condition during winding. After the coil has been wound and any taps according to the present invention have been taken, collapsing means of the mandrel are activated to enable the wound coil to be withdrawn from the mandrel without disturbing the coil structure. The result is a self-supporting, bobbinless coil.

As can be seen, in accordance with the invention, an arrangement is provided for winding the tap so that it occurs at the end of the layer. The winding quality is consistently good. In addition, the coil can be wound using a computer controlled winding machine. The rejects resulting from this winding process are practically eliminated.

What is claimed is:

1. A coil, comprising:

winding support means for supporting a base layer of wire including a first predetermined number of turns wound in a precision pattern about said support means;

a wire tap layer wound about said support means, the wire wound at an average pitch ratio substantially equal to a second predetermined number of turns for said tap layer divided into said first predetermined number of turns;

a tap of wire taken from an end of said wire tap layer; and a subsequent wire layer wound over and in an opposite direction to said tap layer, the wire wound at an average pitch ratio substantially equal to said first predetermined number of turns divided by the difference between said first predetermined number of turns and said second predetermined number of turns in said tap layer.

2. The coil of claim 1, wherein said winding support means is a bobbin.

3. The coil of claim 2, wherein said bobbin includes a core having flanges secured to each end of said core.

4. The coil of claim 3, wherein said core is rectangular in cross section.

5. The coil of claim 3, wherein said core is hollow.

6. The coil of claim 4, wherein said bobbin includes scoring at each corner of the rectangle.

7. The coil of claim 3, wherein said flange further comprises an opening therethrough for the passage of wire.

8. The coil of claim 1, wherein said wire is of circular cross section.

9. The coil of claim 1, wherein said winding support means is collapsible, removable mandrel.

10. The coil of claim 9, wherein said mandrel is rectangular.

11. The coil of claim 10, wherein said mandrel includes scoring at each corner of said rectangle.

12. A method of winding a coil, comprising:

providing a lengthened winding support means for supporting a base layer of wire including a first predetermined number of turns wound in a precision pattern about said support means;

winding a wire tap layer wound about said support means, the wire wound at an average pitch ratio substantially equal to a second predetermined number of turns for said tap layer divided into said first predetermined number of turns;

tapping said wire from an end of said wire tap layer; and winding a subsequent wire layer wound over and in an opposite direction to said tap layer, the wire wound at an average pitch ratio substantially equal to said first predetermined number of turns divided by the difference between said first predetermined number of turns and said second predetermined number of turns in said tap layer.

13. The method of claim 12, wherein said wire is wound about said support means by a winding machine.

14. The method of claim 12, wherein said support means includes a core having flanges secured to each end of said core.

15. The method of claim 14, wherein said core is rectangular in cross section.

16. The method of claim 15, wherein said core is hollow.

17. The method of claim 14, wherein said flange further comprises an opening therethrough for the passage of wire.

18. The method of claim 12, wherein said wire is of circular cross section.

19. The method of claim 12, wherein said winding support means is a collapsible, removable mandrel.

20. The method of claim 19, wherein said mandrel is rectangular.

21. The method of claim 20, wherein said mandrel includes scoring at each corner of said rectangle.

* * * * *